US008459781B2

(12) United States Patent
Ohsawa

(10) Patent No.: US 8,459,781 B2
(45) Date of Patent: Jun. 11, 2013

(54) INKJET HEAD AND METHOD OF MANUFACTURING THE SAME

(75) Inventor: Masafumi Ohsawa, Susono (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/410,655

(22) Filed: Mar. 2, 2012

(65) Prior Publication Data

US 2012/0229576 A1 Sep. 13, 2012

(30) Foreign Application Priority Data

Mar. 8, 2011 (JP) ..... 2011-050530

(51) Int. Cl.
*B41J 2/045* (2006.01)

(52) U.S. Cl.
USPC ..... 347/68; 347/72; 347/69; 347/70; 347/71; 29/25.35

(58) Field of Classification Search
USPC ..... 347/68–72; 29/25.35
See application file for complete search history.

(56) References Cited

FOREIGN PATENT DOCUMENTS

| | | |
|---|---|---|
| JP | 09-109401 | 4/1997 |
| JP | 2004-160874 | 6/2004 |

*Primary Examiner* — Matthew Luu
*Assistant Examiner* — Henok Legesse
(74) *Attorney, Agent, or Firm* — Turocy & Watson, LPP

(57) ABSTRACT

According to one embodiment, an inkjet head comprises a main body which is adhered onto a substrate with an adhesive layer. The substrate includes inflow parts that are opened to a mounting surface. Side surfaces of the main body, internal surfaces of the grooves, an end part of the adhesive layer, and the mounting surface are covered with a conductive layer. The conductive layer is provided with insulating patterns. The insulating patterns run between the grooves and extending to the mounting surface.

20 Claims, 10 Drawing Sheets

INKJET HEAD AND METHOD OF MANUFACTURING THE SAME

CROSS-REFERENCE TO RELATED APPLICATIONS

This application is based upon and claims the benefit of priority from the prior Japanese Patent Application No. 2011-050530, filed on Mar. 8, 2011, the entire contents of which are incorporated herein by reference.

FIELD

Embodiments described herein relate generally to an inkjet head, in which an actuator that pressurizes ink is adhered onto a substrate, and a method of manufacturing the same.

BACKGROUND

For example, inkjet heads, in which an actuator formed of PZT is adhered onto a substrate formed of alumina by using an epoxy-based adhesive, are known. According to the inkjet heads of this type, the actuator includes a plurality of grooves which are filled with ink. The grooves are arranged at intervals in a longitudinal direction of the actuator, and continuously opened to the surface and side surfaces of the actuator. The side surfaces of the actuator are inclined from the surface of the actuator toward the substrate, to project from the actuator sideward. The adhesive is filled into a space between the substrate and the actuator, and forms an adhesive layer between the substrate and the actuator. The adhesive layer includes an end part which is exposed from a space between the side surfaces of the actuator and the substrate.

Internal surfaces of the grooves of the actuator are provided with respective electrodes. The electrodes are formed by continuously covering the internal surfaces of the grooves of the actuator, the side surfaces of the actuator, and the substrate with a plating layer, and thereafter irradiating the plating layer with laser light from above.

A part of the plating layer, which is irradiated with laser light, defines a plurality of insulating patterns. The insulating patterns divide the plating layer into a plurality of electrodes, and cross the end part of the adhesive layer through a space between adjacent grooves and reach the substrate.

According to inkjet heads of prior art, the air is sometimes taken into the adhesive when the actuator is adhered onto the substrate. The taken air remains in the adhesive layer as an air bubble. When the air bubble is located in the end part of the adhesive layer, the end part of the adhesive layer includes a depression. In addition, the depression is covered with the plating layer together with the side surfaces of the actuator and the substrate, when the electrodes are formed.

The depression is more depressed than the side surfaces of the actuator. Therefore, even when the worker tries to remove the plating layer which covers the depression by laser light, the side surfaces of the actuator blocks the laser light which goes toward the depression. In other words, the laser light does not reach the depression, and the plating layer in the depression is left without being removed by the laser light. As a result, the insulating patterns are interrupted in a position of the depression of the adhesive layer. Therefore, the depression generated in the adhesive layer causes a short between electrodes which are adjacent to each other with the insulating pattern interposed therebetween.

DETAILED DESCRIPTION

In general, according to one embodiment, an inkjet head comprises an actuator and a substrate. The actuator includes an elongated main body which includes a front surface, a back surface, and a pair of inclined side surfaces, and a plurality of grooves which are arranged at intervals in a longitudinal direction of the main body. The main body is adhered onto a mounting surface of the substrate with an adhesive layer interposed therebetween. The substrate includes a plurality of inflow parts that are opened to the mounting surface. The side surfaces of the main body, internal surfaces of the grooves, an end part of the adhesive layer which is exposed between each side surface of the main body and the mounting surface of the substrate, and the mounting surface of the substrate are covered with a conductive layer. The conductive layer is provided with a plurality of insulating patterns. The insulating patterns run between the grooves and extending to the mounting surface of the substrate through the end part of the adhesive layer, and are configured to divide the conductive layer into a plurality of electrodes.

First Embodiment

Figure 1:
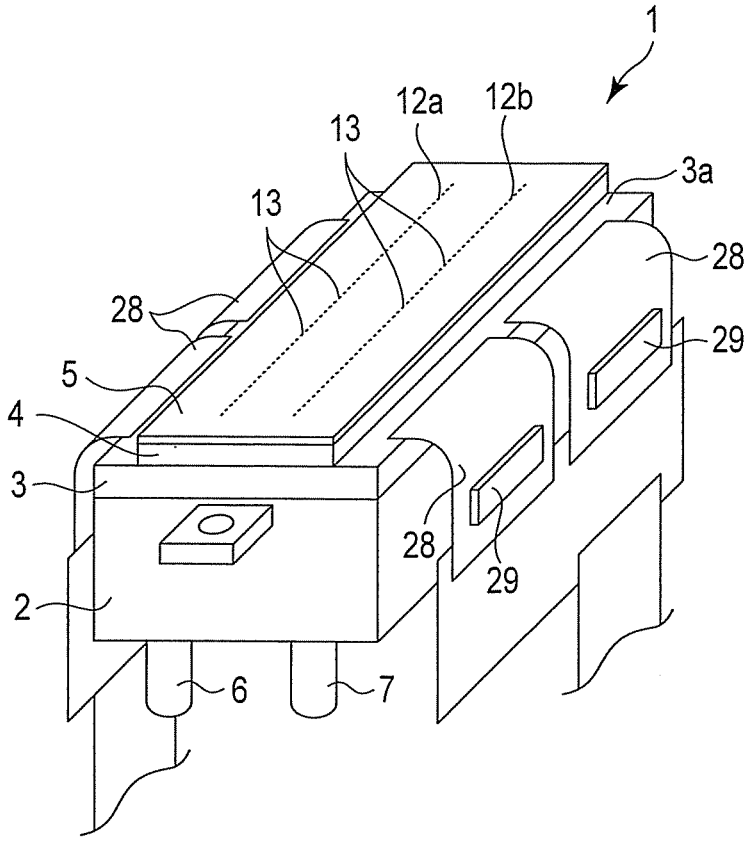
FIG. 1 is a perspective view of an inkjet head according to a first embodiment.
Figure 2:
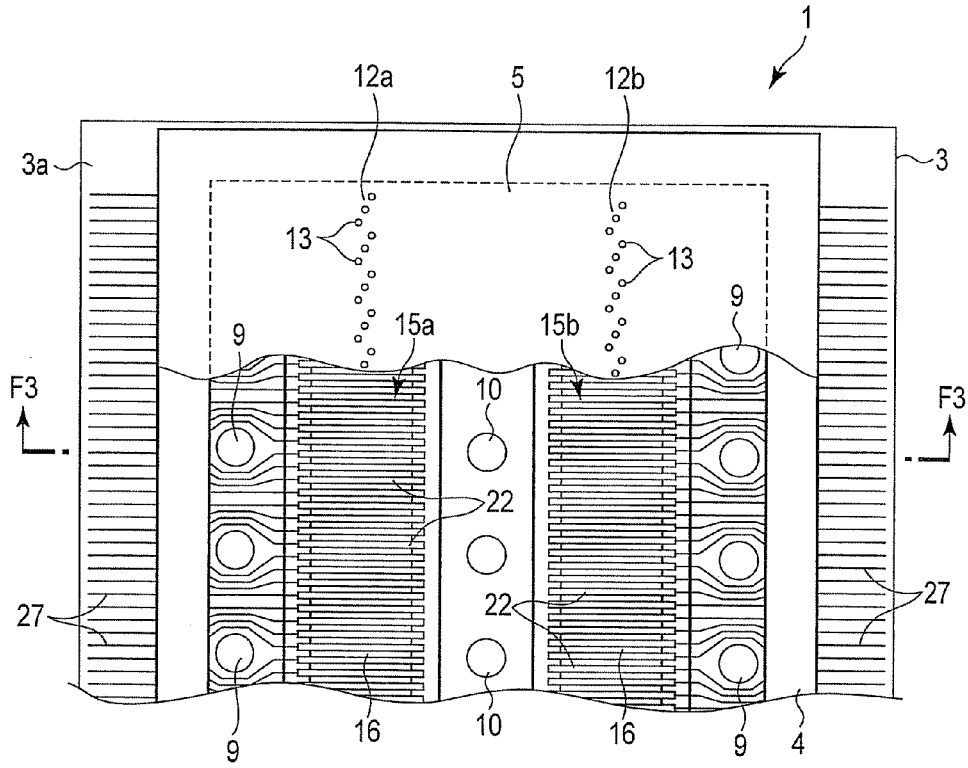
FIG. 2 is a plan view of the inkjet head according to the first embodiment.
Figure 3:
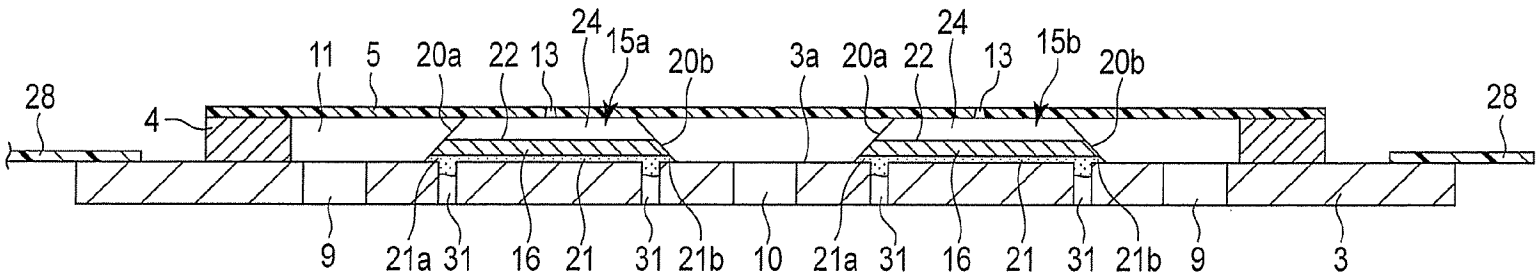
FIG. 3 is a cross-sectional view taken along line F3-F3 of FIG. 2.

FIG. 1 to FIG. 3 disclose an on-demand inkjet head 1 which is used by being mounted onto a carriage of a printer. The inkjet head 1 comprises an ink tank 2, a substrate 3, a spacer 4, and a nozzle plate 5. The ink tank 2 is connected to an ink cartridge through an ink supply pipe 6 and an ink return pipe 7.

The substrate 3 is superposed on the ink tank 2 to cover an opening end of the ink tank 2. The substrate 3 is formed of, for example, alumina, and includes an elongated mounting surface 3*a*. The substrate 3 is provided with a plurality of ink supply holes 9 and a plurality of ink discharge holes 10. The ink supply holes 9 and the ink discharge holes 10 are opened in the mounting surface 3*a*.

Figure 5:
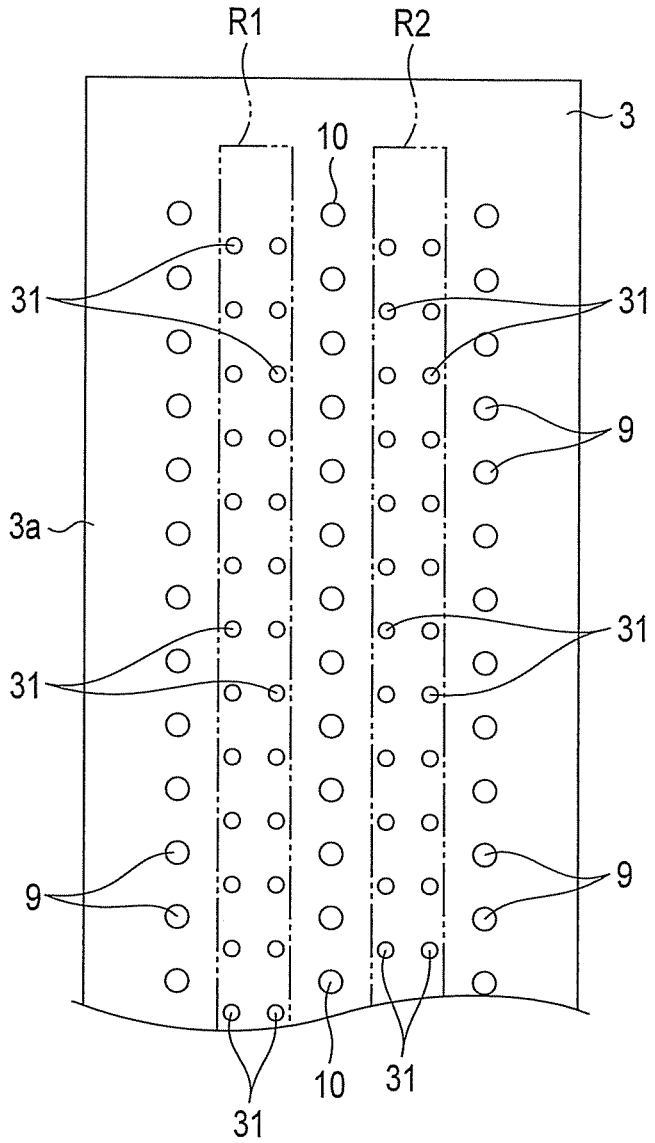
FIG. 5 is a plan view of a substrate used in the first embodiment.

As illustrated in FIG. 3 and FIG. 5, the ink supply holes 9 are arranged in two lines in a width direction of the substrate 3, and arranged at intervals in a longitudinal direction of the substrate 3. The ink discharge holes 10 are located in a center part along the width direction of the substrate 3, and arranged in a line at intervals in the longitudinal direction of the substrate 3.

The spacer 4 has a rectangular frame shape. The spacer 4 is adhered onto the mounting surface 3*a* of the substrate 3, and surrounds the ink supply holes 9 and the ink discharge holes 10.

The nozzle plate 5 is formed of a resin film such as polyimide, or a silicon substrate. The nozzle plate 5 is adhered onto the spacer 4, and opposed to the substrate 3.

As illustrated in FIG. 3, the substrate 3, the spacer 4, and the nozzle plate 5 form an ink circulation chamber 11 in cooperation. The ink circulation chamber 11 communicates with the ink tank 2 through the ink supply holes 9 and the ink discharge holes 10. The ink supply holes 9 supply ink from the ink tank 2 to the ink circulation chamber 11. Excessive ink which is supplied to the ink circulation chamber 11 is returned to the ink tank 2 through the ink discharge holes 10.

As illustrated in FIG. 1 and FIG. 2, the nozzle plate 5 includes first and second nozzle lines 12*a* and 12*b*. The first and second nozzle lines 12*a* and 12*b* are arranged in parallel with each other, and with a space between them in the width direction of the nozzle plate 5, such that they extend in the longitudinal direction of the nozzle plate 5. Each of the first and second nozzle lines 12*a* and 12*b* includes a plurality of nozzles 13. The nozzles 13 are opened to the ink circulation chamber 11, and opposed to a recording medium such as recording paper.

First and second actuators 15*a* and 15*b* are contained in the ink circulation chamber 11. The first actuator 15*a* is mounted onto the mounting surface 3*a* of the substrate 3, to correspond to the first nozzle line 12*a*. The first actuator 15*a* is located between the ink supply holes 9 and the ink discharge holes 10. In the same manner, the second actuator 15*b* is mounted onto the mounting surface 3*a* of the substrate 3, to correspond to the second nozzle line 12*b*. The second actuator 15*b* is located between the ink supply holes 9 and the ink discharge holes 10.

The first actuator 15*a* and the second actuator 15*b* have a structure common to them. Therefore, in the first embodiment, the first actuator 15*a* is explained as a representative, and explanation of the second actuator 15*b* is omitted by providing the second actuator 15*b* with reference numerals which are the same as those of the first actuator 15*a*.

Figure 4:
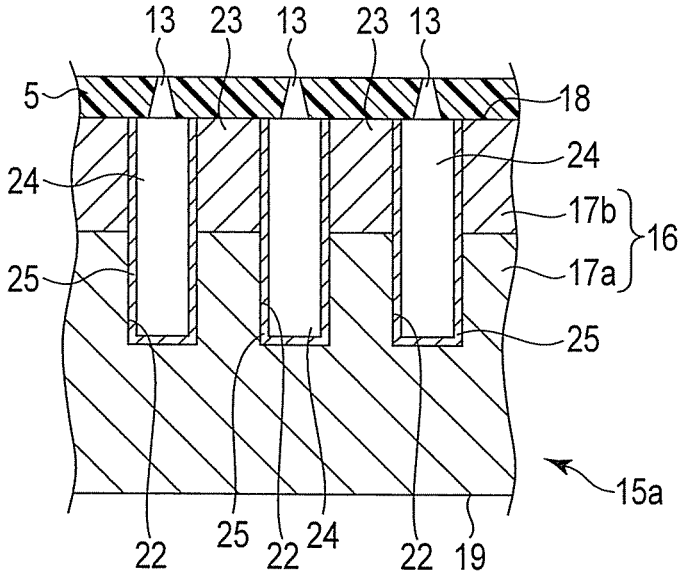
FIG. 4 is a cross-sectional view of a first actuator.

As illustrated in FIG. 4, the first actuator 15*a* includes a main body 16 formed of PZT (lead zirconate titanate). The main body 16 is formed by superposing two piezoelectric members 17*a* and 17*b* on each other. The piezoelectric members 17*a* and 17*b* are polarized in opposite directions in a thickness direction of the piezoelectric members 17*a* and 17*b*.

The main body 16 of the actuator 15*a* has an elongated plate shape which extends in the longitudinal direction of the ink circulation chamber 11. The main body 16 includes a front surface 18, a back surface 19, and a pair of side surfaces 20*a* and 20*b*. The front surface 18 faces the nozzle plate 5. The back surface 19 is located reverse to the front surface 18, and faces the mounting surface 3*a* of the substrate 3.

One side surface 20*a* connects one side edge of the front surface 18, which runs along a width direction of the front surface 18, with one side edge of the back surface 19, which runs along a width direction of the back surface 19. The other side surface 20*b* connects the other side edge of the front surface 18, which runs along the width direction of the front surface 18, and the other side edge of the back surface 19, which runs along the width direction of the back surface 19.

Figure 9:
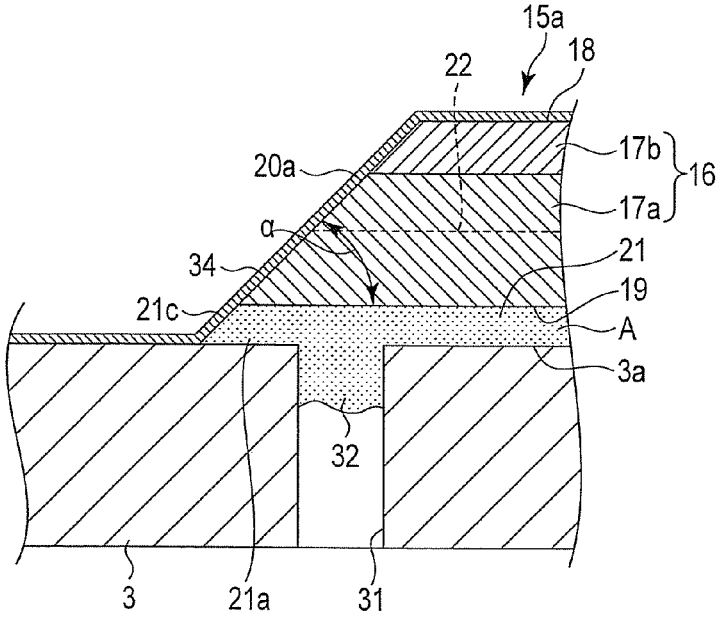
FIG. 9 is a cross-sectional view of a state of the first embodiment, in which a side surface of the actuator, an end part of the adhesive layer, and the mounting surface of the substrate are covered with a plating layer.

In addition, the side surfaces 20*a* and 20*b* are inclined such that they go away from each other as they go from the front surface 18 toward the back surface 19. In other words, the main body 16 spreads in a flare shape from the front surface 18 toward the back surface 19. As illustrated in FIG. 9, the angle $\alpha$ of inclination of the side surfaces 20*a* and 20*b* with respect to the back surface 19 is 45°.

The main body 16 is adhered onto the mounting surface 3*a* of the substrate 3 by using, for example, an epoxy-based adhesive A. The adhesive A is filled into a space between the mounting surface 3*a* of the substrate 3 and the back surface 19 of the main body 16, and forms an adhesive layer 21 between the substrate 3 and the main body 16.

The adhesive layer 21 includes a pair of end parts 21*a* and 21*b*. The end parts 21*a* and 21*b* are apart from each other in a width direction of the main body 16. In addition, the end parts 21*a* and 21*b* continue in a longitudinal direction of the main body 16, and are exposed through spaces between the mounting surface 3*a* of the substrate 3 and the side surfaces 20*a* and 20*b*, respectively, of the main body 16.

Each of the end parts 21*a* and 21*b* of the adhesive layer 21 includes an external surface 21*c*. The external surface 21*c* is inclined to run along the side surface 20*a* or 20*b* of the main body 16, and connects the side surface 20*a* or 20*b* of the main body 16 and the mounting surface 3*a* of the substrate 3. The external surface 21*c* is located on the same plane as the side surface 20*a* or 20*b*.

The main body 16 is provided with a plurality of grooves 22. The grooves 22 are arranged at intervals in the longitudinal direction of the main body 16, and continuously opened to the front surface 18 and the side surfaces 20*a* and 20*b* of the main body 16. Two adjacent grooves 22 are partitioned by a partition wall 23.

The front surface 18 of the main body 16, in which the grooves 22 are opened, contacts the nozzle plate 5. A space which is defined by each groove 22 and the nozzle plate 5 forms a pressure chamber 24. Pressure chambers 24 communicate with the ink circulation chamber 11, and correspond to the respective nozzles 13 of the nozzle plate 5. Therefore, ink which flows through the ink circulation chamber 11 is filled into the pressure chambers 24.

Figure 11:
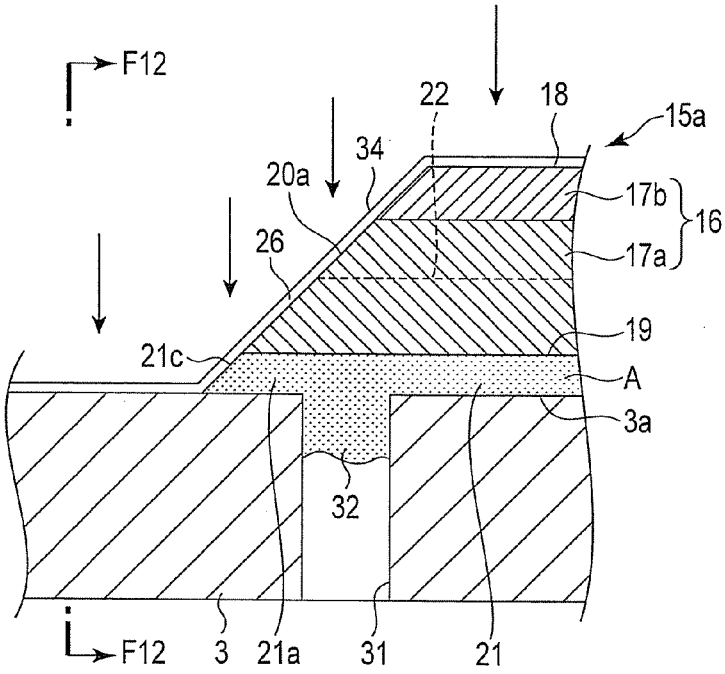
FIG. 11 is a cross-sectional view of a state of the first embodiment, in which an insulating pattern is formed in the actuator by irradiating the plating layer with laser light.
Figure 12:
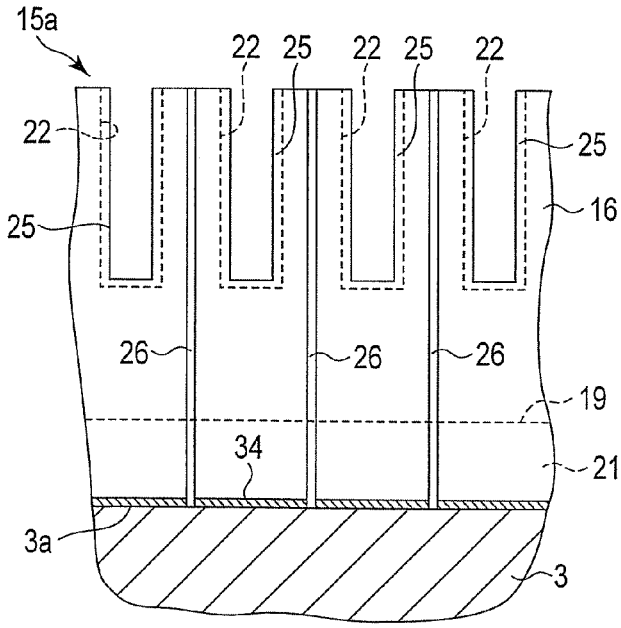
FIG. 12 is a cross-sectional view taken along line F12-F12 of FIG. 11.

Electrodes 25 are formed on internal surfaces of the respective grooves 22. As illustrated in FIG. 11 and FIG. 12, electrodes 25 of two adjacent grooves 22 are electrically separated from each other by an insulating pattern 26. Each insulating pattern 26 runs on the external surface 21*c* of the adhesive layer 21 from the side surface 20*a* or 20*b* of the main body 16, and extends to the mounting surface 3*a* of the substrate 3.

In addition, the electrodes 25 are electrically connected to a plurality of conductor patterns 27 which are formed on the mounting surface 3*a* of the substrate 3. As illustrated in FIG. 2, distal ends of the conductor patterns 27 are guided to the outside of the spacer 4, and connected to a plurality of tape carrier packages 28. Each tape carrier package 28 is equipped with a driving circuit 29 which drives the inkjet head 1.

The driving circuits 29 apply voltage to the electrodes 25 of the inkjet head 1. Thereby, a difference in potential is generated between two electrodes 25 which are adjacent to each other with a pressure chamber 24 interposed therebetween, and the partition walls 23 which correspond to the electrodes 25 shear to warp in a direction of increasing the volume of the pressure chamber 24.

When application of driving voltage to the electrodes 25 is cut off, the partition walls 23 return to their initial positions. Ink filled into the pressure chambers 24 is pressurized as a result of returning the partition walls 23 to their initial positions. Part of the pressurized ink changes to a plurality of ink drops, and is ejected from the nozzles 13 onto the recording medium.

As illustrated in FIG. 5, the substrate 3 includes two regions R1 and R2, to which the main bodies 16 of the first and second actuators 15*a* and 15*b*, respectively, are adhered. The regions R1 and R2 are arranged in two lines in the width direction of the substrate 3, and extend in the longitudinal direction of the substrate 3.

Each of the regions R1 and R2 of the substrate 3 is provided with a plurality of through-holes 31. The through-holes 31 are an example of an inflow part. The through-holes 31 are arranged at intervals in the longitudinal direction of the main body 16, to correspond to positions of the side surfaces 20*a* and 20*b* of the main body 16. In the first embodiment, each through-hole 31 is located just under a partition wall 23 which partitions two adjacent grooves 22.

The through-holes 31 are opened to the mounting surface 3*a* of the substrate 3, in positions corresponding the side surfaces 20*a* and 20*b* of the main body 16. Therefore, an opening end of each through-hole 31 is covered with the adhesive layer 21, and part 32 of the adhesive A enters each through-hole 31.

A process of manufacturing the inkjet head 1 having the above structure will be explained hereinafter.

Figure 6:
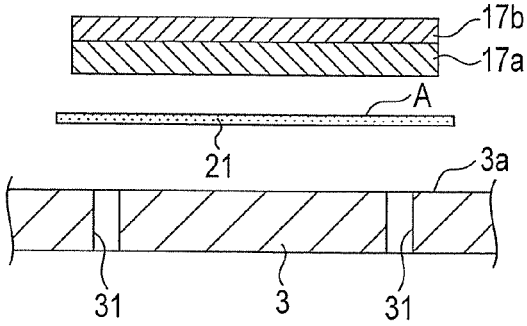
FIG. 6 is a cross-sectional view of a state in the first embodiment, in which two layered piezoelectric members, an adhesive layer, and a substrate are separated from each other.

First, as illustrated in FIG. 6, piezoelectric members 17*a* and 17*b* which serve as the basis of the actuator 15*a* are adhered onto the mounting surface 3*a* of the substrate 3 by adhesive A. The adhesive A is filled into a space between the piezoelectric member 17*a* and the mounting surface 3*a* of the substrate 3, and forms the adhesive layer 21.

Figure 7:
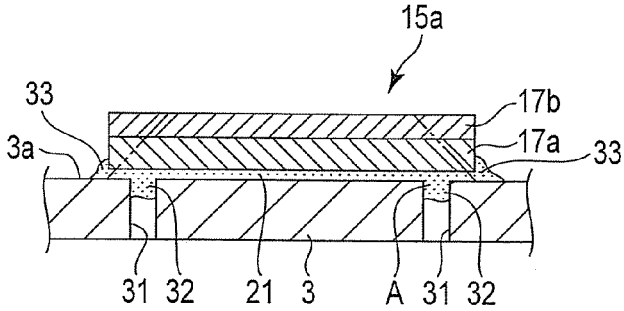
FIG. 7 is a cross-sectional view of a state in the first embodiment, in which the piezoelectric members are adhered onto a mounting surface of the substrate by the adhesive layer.

As illustrated in FIG. 7, surplus adhesive A is forced out of the space between the piezoelectric member 17*a* and the mounting surface 3*a* of the substrate 3. The surplus adhesive A which is forced out forms surplus parts 33 which rise in a fillet shape in corner parts which are defined by side surfaces of the piezoelectric member 17*a* and the mounting surface 3*a* of the substrate 3. In addition, parts 32 of the adhesive A flow into the through-holes 31 of the substrate 3.

When the piezoelectric members 17*a* and 17*b* are adhered to the mounting surface 3*a* of the substrate 3, the air may be taken into the adhesive A. When an air bubble caused by the taken air is generated in the adhesive A, the air bubble is guided into any through-hole 31 with the flow of the adhesive A. As a result, the air bubble is removed from the adhesive layer 21 which is filled into the space between the mounting surface 3*a* of the substrate 3 and the piezoelectric member 17*a*.

In particular, the through-holes 31 are located just under both end parts of the piezoelectric member 17*a*, which are located along the width direction of the piezoelectric member 17*a*. Thereby, adhesive A which does not include any air bubbles is tightly filled into the space between the mounting surface 3*a* of the substrate 3 and both end parts of the piezoelectric member 17*a*.

Thereafter, the piezoelectric members 17*a* and 17*b* which are adhered to the substrate 3 are subjected to machining, and thereby both end parts of the piezoelectric members 17*a* and 17*b* which are located along the width direction of the piezoelectric members 17*a* and 17*b* are obliquely cut, as illustrated by two-dot chain lines in FIG. 7. Consequently, the main body 16 which includes inclined side surfaces 20*a* and 20*b* is formed.

Figure 8:
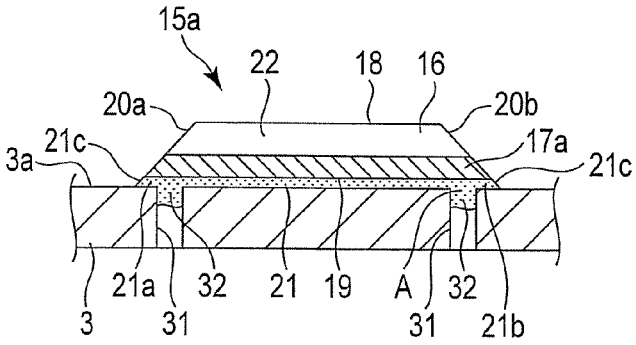
FIG. 8 is a cross-sectional view of the first embodiment, illustrating positional relation between through-holes provided in the substrate and side surfaces of the actuator.

When both end parts of the piezoelectric members 17*a* and 17*b* are cut, the surplus parts 33 of the adhesive A, which are forced out of the piezoelectric members 17*a* and 17*b* are removed. Thereby, as illustrated in FIG. 8, end parts 21*a* and 21*b* of the adhesive layer 21 are exposed through spaces between the mounting surface 3*a* of the substrate 3 and the side surfaces 20*a* and 20*b*, respectively, of the main body 16. Simultaneously, each of the end parts 21*a* and 21*b* of the adhesive layer 21 is provided with the external surface 21*c* which is inclined to run along the side surface 20*a* or 20*b* of the main body 16.

Figure 10:
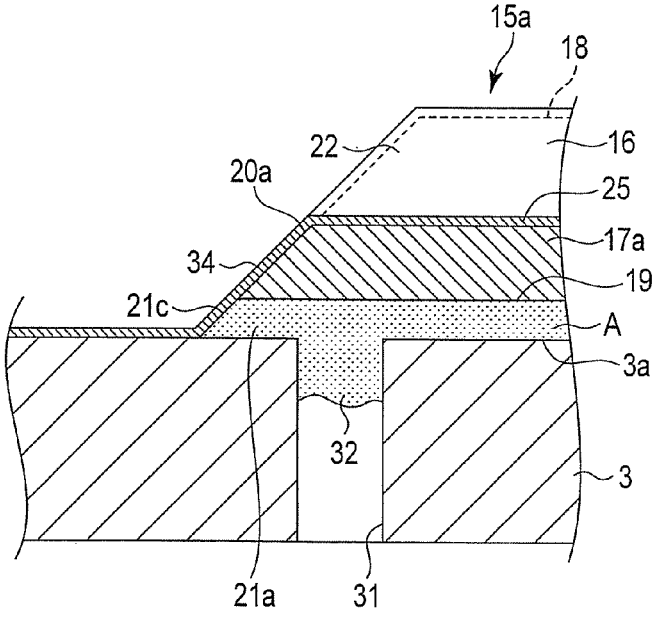
FIG. 10 is a cross-sectional view of a state of the first embodiment, in which an internal surface of the groove of the actuator, the end part of the adhesive layer, and the mounting surface of the substrate are covered with the plating layer.

Thereafter, a plurality of grooves 22 are formed in the main body 16. Then, the substrate 3 and the main body 16 are subjected to plating. Thereby, as illustrated in FIG. 9 and FIG. 10, for example, the mounting surface 3*a* of the substrate 3, the front surface 18, the side surfaces 20*a* and 20*b*, and the internal surfaces of the grooves 22 of each main body 16, and the external surfaces 21*c* of the adhesive layer 21 are continuously covered with a plating layer 34. The plating layer 34 is an example of a conductive layer.

Thereafter, a plurality of insulating patterns 26 are formed on the plating layer 34 by, for example, photolithography using laser light. Specifically, as illustrated by arrows in FIG. 11, laser light is applied onto the plating layer 34 from above.

The laser light is applied onto parts of the plating layer 34, which correspond to the partition walls 23 that partition the grooves 22. The parts which are irradiated with laser light among the plating layer 34 are left as irradiation marks, from which the plating layer 34 is removed. The irradiation marks form the insulating patterns 26 on the plating layer 34. The insulating patterns 26 run on the external surfaces 21*c* of the adhesive layer 21 from the side surfaces 20*a* and 20*b* of the main body 16, and reach the mounting surface 3*a* of the substrate 3.

Consequently, the plating layer 34 is divided by the insulating patterns 26 into a plurality of regions which correspond to the grooves 22, and the regions of the plating layer 34 form electrodes 25 which correspond to the respective grooves 22.

According to the first embodiment, even when an air bubble is generated in the adhesive A which adheres the piezoelectric members 17*a* and 17*b* onto the mounting surface 3*a* of the substrate 3, the air bubble is pushed out of the substrate 3 together with the flow of the adhesive A through the through-holes 31 of the substrate 3.

In particular, since the through-holes 31 are located under both end parts, which are obliquely cut, of the piezoelectric members 17*a* and 17*b*, the adhesive A which includes no air bubbles is tightly filled into the spaces between the mounting surface 3*a* of the substrate 3 and both end parts of the piezoelectric member 17*a*.

As a result, a depression which is caused by an air bubble is not formed in the external surfaces 21*c* of the adhesive layer 21, when the surplus parts 33 of the adhesive layer 21 are obliquely cut together with both end parts of the piezoelectric members 17*a* and 17*b*. In other words, the external surfaces 21*c* of the adhesive layer 21 become flat surfaces which continue to the side surfaces 20*a* and 20*b* of the main body 16. Therefore, as illustrated in FIG. 9, in a state where the substrate 3 and the main body 16 are plated, the parts of the plating layer 34, which covers the external surfaces 21*c* of the adhesive layer 21, are located on the same plane as parts of the plating layer 34, which cover the side surfaces 20*a* and 20*b* of the main body 16.

Therefore, when insulating patterns 26 are formed on the plating layer 34, laser light is surely applied to parts of the plating layer 34, which cover the external surfaces 21*c* of the adhesive layer 21. This structure prevents interruption of the insulating patterns 26 in positions which correspond to the external surfaces 21*c* of the adhesive layer 21.

Figure 13:
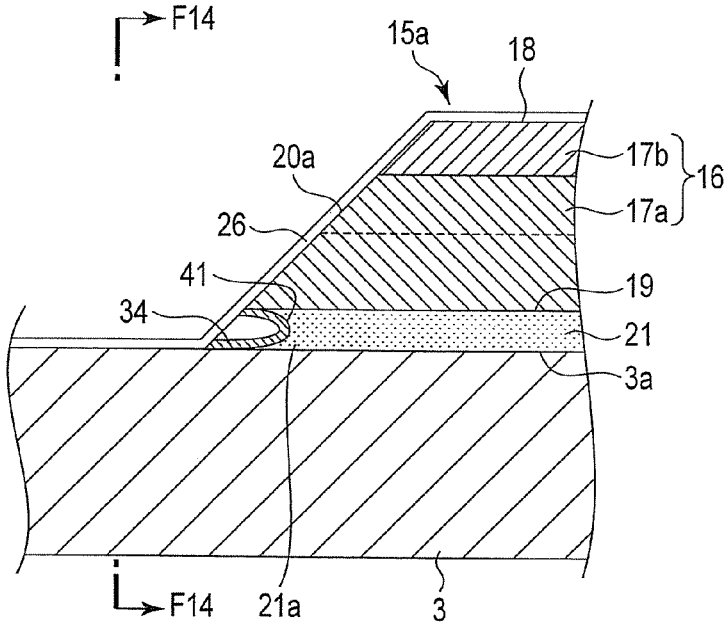
FIG. 13 is a cross-sectional view of a state where a depression which is caused by an air bubble taken into the adhesive is formed in the end part of the adhesive layer, and the insulating pattern is interrupted in a position of the depression.
Figure 14:
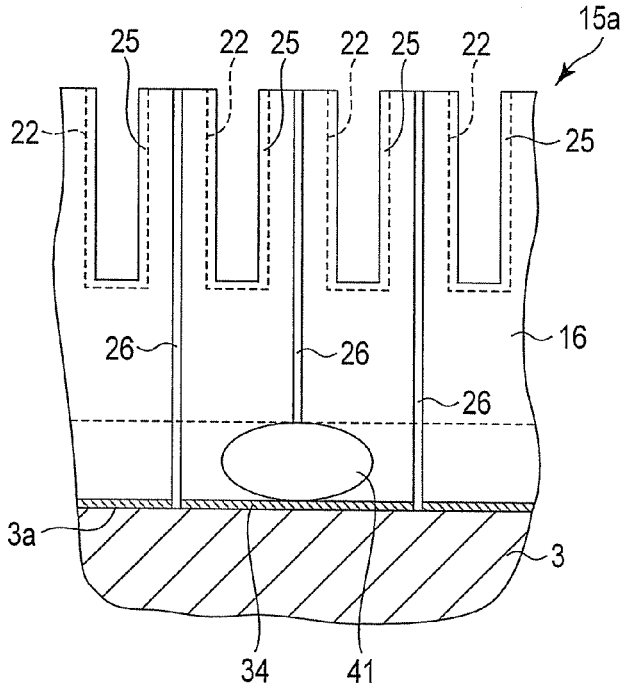
FIG. 14 is a cross-sectional view taken along line F14-F14 of FIG. 13.

On the other hand, FIG. 13 and FIG. 14 illustrate a comparative example in which a depression 41 which is caused by an air bubble mixed in the adhesive A is formed in an end part 21*a* of the adhesive layer 21. The depression 41 is generated in the end part 21*a* of the adhesive layer 21, when the surplus parts 33 of the adhesive A illustrated in FIG. 7 are removed from the adhesive layer 21. In addition, the depression 41 is exposed through a space between the side surface 20*a* of the main body 16 and the mounting surface 3*a* of the substrate 3.

Therefore, due to existence of the depression 41, the end part 21*a* of the adhesive layer 21 is not located on the same plane as the side surface 20*a* of the main body 16. Conversely, the end part 21*a* of the adhesive layer 21 has a depressed shape to go into the space between the back surface 19 of the main body 16 and the mounting surface 3*a* of the substrate 3.

In addition, when the substrate 3 and the main body 16 are plated, the plating layer 34 is also formed on an internal surface of the depression 41. The plating layer 34 is divided into a plurality of electrodes 25 by a plurality of insulating patterns 26 which are obtained by applying laser light from above.

However, since the depression 41 is more depressed than the side surface 20*a* of the main body 16, the side surface 20*a* of the main body 16 shuts off laser light which goes toward the depression 41. Therefore, the plating layer 34 which covers the depression 41 is left without being removed by the laser light, and the insulating patterns 26 which divide the plating layer 34 into the electrodes 25 are interrupted in the position of the depression 41. Therefore, two adjacent electrodes 25 are shorted, due to existence of the plating layer 34 which is left in the depression 41.

In comparison with this, according to the first embodiment, the insulating patterns 26 reach above the mounting surface 3*a* of the substrate 3, without being interrupted in the position corresponding to any external surface 21 of the adhesive layer 21. Therefore, the plating layer 34 can be surely divided into electrodes 25, and a short between two adjacent electrodes 25 can be prevented.

Second Embodiment

Figure 15:
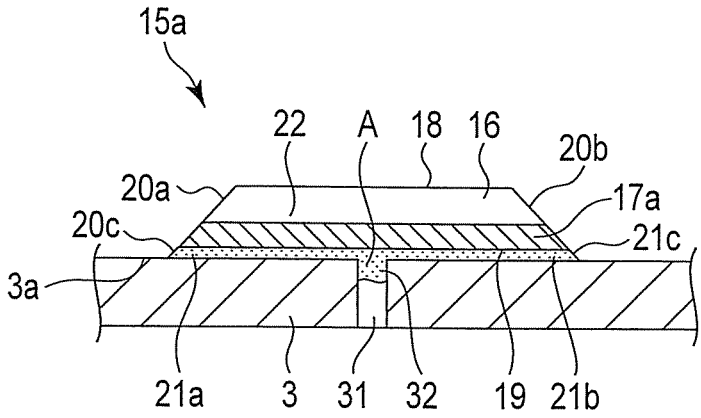
FIG. 15 is a cross-sectional view of a second embodiment, illustrating positional relation between an actuator and a through-hole provided in a substrate.

FIG. 15 discloses a second embodiment.

In the second embodiment, through-holes 31, into which adhesive A flows, are formed in positions which correspond to a center part of a main body 16, which is located along a width direction of the main body 16. The structure of an inkjet head 1 of the second embodiment other than this part is the same as that of the first embodiment.

According to the above structure, even when an air bubble is generated in the adhesive A, the air bubble moves together with flow of the adhesive A when piezoelectric members 17*a* and 17*b* are adhered onto a mounting surface 3*a* of a substrate 3, and flows into any of the through-holes 31. As a result, the possibility that an air bubble moves to end part 21*a* or 21*b* of an adhesive layer 21 is reduced, and a depression which causes interruption of insulating patterns is hardly generated in the end parts 21*a* or 21*b* of the adhesive layer 21. Therefore, the second embodiment can obtain the same effect as that of the first embodiment.

The means for forming insulating patterns on the plating layer is not limited to photolithography using laser light. For example, it is possible to adopt lithography using electron beams or ion beams instead of laser light.

In addition, the inflow part of the substrate is not limited to through-holes which pierce the substrate. For example, the inflow part can be carried out as a depression which has a bottom.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

an actuator which includes an elongated main body and a plurality of grooves, the main body including a front surface, a back surface, and a pair of side surfaces, the side surfaces connecting the front surface with the back surface and being inclined from the front surface toward the back surface to go away from each other, the grooves being arranged at intervals in a longitudinal direction of the main body and configured to be continuously opened to the front surface and the side surfaces of the main body;

a substrate which includes a mounting surface on which the main body of the actuator is mounted, and a plurality of inflow parts that are opened to the mounting surface;

an adhesive layer which fixes the actuator onto the substrate, the adhesive layer being interposed between the actuator and the mounting surface of the substrate to cover an open end of each of the inflow parts, and including an end part which is exposed between each side surface of the actuator and the mounting surface of the substrate; and a plurality of insulating patterns which are provided on a conductive layer that covers the side surfaces of the actuator, internal surfaces of the grooves, the end part of the adhesive layer, and the mounting surface of the substrate, the insulating patterns running between the grooves and extending to the mounting surface of the substrate through the end part of the adhesive layer, and being configured to divide the conductive layer into a plurality of electrodes that correspond to the respective grooves.

2. The inkjet head of claim 1, wherein the inflow parts are arranged at intervals in a direction in which the grooves of the actuator are arranged.

3. The inkjet head of claim 1, wherein the inflow parts are through-holes which pierces the substrate.

4. The inkjet head of claim 1, wherein the end part of the adhesive layer includes an external surface which is inclined along the side surface of the actuator.

5. The inkjet head of claim 2, wherein
the actuator includes a plurality of walls, each of which partition two adjacent grooves of the grooves, and the inflow parts are located under the walls.

6. The inkjet head of claim 3, wherein
the through-holes are opened to the mounting surface in positions which correspond to the side surfaces of the main body.

7. The inkjet head of claim 3, wherein
the through-holes are provided in a center part of the main body which is located along a width direction of the main body, which is perpendicular to the longitudinal direction of the main body, such that the through-holes are located between the side surfaces of the main body.

8. The inkjet head of claim 4, wherein
the insulating patterns are formed on the external surface of the adhesive layer.

9. The inkjet head of claim 4, wherein
the conductive layer includes a first part which covers the external surface of the adhesive layer, and a second part which covers the side surface of the actuator, and the first part and the second part are located on a plane.

10. The inkjet head of claim 6, wherein
the adhesive layer is formed of an adhesive which is filled into a space between the actuator and the mounting surface of the substrate.

11. The inkjet head of claim 10, wherein
the adhesive layer includes a part which enters the through-holes.

12. An inkjet head comprising:
an actuator which includes an inclined surface, and a plurality of grooves which are opened to the inclined surface;
a substrate which includes a mounting surface onto which the actuator is mounted, and an inflow part that is opened to the mounting surface;
an adhesive layer which fixes the actuator onto the substrate, the adhesive layer being interposed between the actuator and the mounting surface of the substrate to cover an open end of the inflow part, and including an end part which is exposed between the side surface of the actuator and the mounting surface of the substrate; and
a plurality of insulating patterns which are provided on a conductive layer that covers the inclined surface of the actuator, internal surfaces of the grooves, the end part of the adhesive layer, and the mounting surface of the substrate, the insulating patterns running between the grooves and extending to the mounting surface of the substrate through the end part of the adhesive layer, and being configured to divide the conductive layer into a plurality of electrodes that correspond to the respective grooves.

13. The inkjet head of claim 12, wherein
the adhesive layer is formed of an adhesive which is filled into a space between the actuator and the mounting surface of the substrate.

14. The inkjet head of claim 12, wherein
the end part of the adhesive layer includes an external surface which is inclined along the inclined surface of the actuator.

15. The inkjet head of claim 13, wherein
the inflow part is a through-hole which pierces the substrate, and part of the adhesive enters the through-hole.

16. The inkjet head of claim 15, wherein
the insulating patterns are formed on the external surface of the adhesive layer.

17. A method of manufacturing an inkjet head, the inkjet head including:
an actuator which includes an elongated main body and a plurality of grooves, the main body including a front surface, a back surface, and a pair of side surfaces, the side surfaces connecting the front surface with the back surface and being inclined from the front surface toward the back surface to go away from each other, the grooves being arranged at intervals in a longitudinal direction of the main body and configured to be continuously opened to the front surface and the side surfaces of the main body;
a substrate which includes a mounting surface on which the main body of the actuator is mounted,
the method comprising:
forming a plurality of inflow parts, which are opened to the mounting surface, in the substrate such that the inflow parts are covered with the main body of the actuator;
adhering a piezoelectric member onto the mounting surface, to which the inflow parts are opened, with an adhesive layer interposed therebetween;
subjecting the piezoelectric member adhered to the mounting surface to machining, and thereby forming the main body;
continuously covering the side surfaces of the main body, internal surfaces of the grooves, the mounting surface of the substrate, and end parts of the adhesive layer which are exposed through spaces between the mounting surface of the substrate and the side surface of the main body, with a conductive layer; and
providing the conductive layer with a plurality of insulating patterns which run between the grooves and on the end parts of the adhesive layer and extend to the mounting surface of the substrate, and thereby dividing the conductive layer into a plurality of electrodes which correspond to the respective grooves.

18. The method of claim 17, wherein
the adhesive layer is formed by filling the space between the main body and the mounting surface of the substrate with an adhesive, and part of the adhesive enters the inflow parts when the main body is adhered onto the mounting surface.

19. The method of claim 17, wherein
the insulating patterns are formed on the conductive layer by irradiating the conductive layer with light from above.

20. The method of claim 18, wherein
a surplus part of the adhesive goes out of the main body through the spaces between the mounting surface of the substrate and the side surfaces of the main body, when the main body is adhered onto the mounting surface of the substrate, and the surplus part of the adhesive is removed from the adhesive layer when the piezoelectric member is subjected to machining.

* * * * *